US007694724B2

(12) United States Patent
Kolb et al.

(10) Patent No.: US 7,694,724 B2
(45) Date of Patent: Apr. 13, 2010

(54) ENGINE COOLING RADIATOR

(75) Inventors: John A Kolb, Old Lyme, CT (US); Lyman J McWain, Madison, CT (US)

(73) Assignee: Centrum Equities Acquisition, LLC, Nashville, TN (US)

( * ) Notice: Subject to any disclaimer, the term of this patent is extended or adjusted under 35 U.S.C. 154(b) by 1387 days.

(21) Appl. No.: 11/088,297

(22) Filed: Mar. 24, 2005

(65) Prior Publication Data

US 2006/0213644 A1 Sep. 28, 2006

(51) Int. Cl.
*F28D 1/02* (2006.01)

(52) U.S. Cl. ..... 165/81; 165/149

(58) Field of Classification Search ..... 165/140, 165/144, 149, 906, 81
See application file for complete search history.

(56) References Cited

U.S. PATENT DOCUMENTS 2,933,291 A * 4/1960 Huggins ..... 165/149
4,331,201 A * 5/1982 Hesse ..... 165/149
4,540,044 A * 9/1985 Lenz ..... 165/149
4,619,313 A * 10/1986 Rhodes et al. ..... 165/67
4,678,026 A * 7/1987 Lenz et al. ..... 165/149
5,046,554 A * 9/1991 Iwasaki et al. ..... 165/140
5,622,219 A * 4/1997 Voss et al. ..... 165/144
6,736,197 B2 * 5/2004 Nozaki et al. ..... 165/149

* cited by examiner

*Primary Examiner*—Leonard R Leo
(74) *Attorney, Agent, or Firm*—DeLio & Peterson, LLC; Peter W. Peterson

(57) ABSTRACT

A radiator includes a core for cooling a fluid, and a tank connected to the core having a side surface with a depression extending between the front and rear surfaces adapted to receive a hose and a plurality of integral ribs formed on the tank external surfaces. The radiator further includes an elongated support member having a body portion removably connected to the core and extending along a side thereof, an end portion removably connected to the tank, and a flexible expansion portion permitting relative movement between the body and end portions to reduce stress during thermal expansion and contraction of the core.

7 Claims, 7 Drawing Sheets

ENGINE COOLING RADIATOR

BACKGROUND OF THE INVENTION

1. Field of the Invention

The present invention relates to heat exchangers and, in particular, to radiators employed with internal combustion engines used in motor vehicles.

2. Description of Related Art

Radiators used for automobiles and other motor vehicles are subject to stresses as the components thereof thermally expand and contract between ambient and operating temperatures. Weight and space restrictions also place constraints on the radiator's performance in cooling the engine coolant. These factors place great limitations on original equipment components specially designed for the motor vehicle. For aftermarket radiators, which are often installed to enhance engine performance and distinctiveness, these limitations place even greater design and manufacturing hurdles, particularly where the design must accommodate different vehicles.

Accordingly, there is a need for high strength and increased cooling ability in aftermarket or replacement engine cooling radiators.

SUMMARY OF THE INVENTION

Bearing in mind the problems and deficiencies of the prior art, it is therefore an object of the present invention to provide an improved and distinctive radiator for high performance motor vehicle applications.

It is another object of the present invention to provide engine cooling radiator tanks that have increased strength and heat transfer.

A further object of the invention is to provide a higher strength engine cooling radiator that is less susceptible to thermal stresses.

It is yet another object of the present invention to provide an engine cooling radiator that permits modification of associated heat exchangers, such as transmission oil coolers or engine oil coolers.

Still other objects and advantages of the invention will in part be obvious and will in part be apparent from the specification.

The above and other objects, which will be apparent to those skilled in art, are achieved in the present invention which is directed to a radiator comprising a core for cooling a fluid and a tank connected to the core for receiving or supplying the fluid to the core. The tank has external front and rear surfaces adjacent the core and an external side surface between the front and back surfaces. The radiator includes a plurality of integral ribs formed on the tank external surfaces, with the ribs extending outward from the tank along at least a portion of the external side and the front or rear surfaces.

The radiator tank ribs provide increased thickness and strength, and increased heat transfer, to the tank. Preferably, the tank has a length direction extending along an end of the core, and the ribs extend in a direction substantially normal to the length direction of the tank. More preferably, the tank and ribs are integrally made of as-cast aluminum.

The core typically has tubes for carrying the fluid, and the radiator further includes a header for connecting the tank to the tubes, the header being welded to the tank. Also, the radiator will typically include a pair of the aforedescribed tanks connected to opposite ends of the core.

In another aspect, the present invention is directed to a radiator comprising a core for cooling a fluid, with the core having front and back surfaces, opposite sides between the front and back surfaces, and opposite ends between the front and back surfaces. A tank is connected to the core at an end thereof for receiving or supplying the fluid to the core. The radiator also includes an elongated member support having a body portion removably connected to the core and extending along a side thereof, an end portion removably connected to the tank, and a flexible expansion portion permitting relative movement between the body and end portions to reduce stress during thermal expansion and contraction of the core.

Preferably, the flexible expansion portion is U-shaped. The radiator may further include threaded fasteners removably connecting the elongated support to the core and tank.

Typically, the radiator includes a pair of the tanks connected to opposite ends of the core, in which case the elongated support member includes an end portion removably connected to each of the tanks, and a flexible expansion portion between the body portion and each end portion. Preferably, an elongated support member is provided on each side of the core and is removably connected to the core and the tanks.

To provide a more compact construction, the radiator tank of any of the aforementioned radiators may include a depression in the external side surface, extending between the tank front and rear surfaces, adapted to receive a hose.

In a further aspect, the present invention is directed to a radiator comprising a core for cooling a fluid and a tank connected to the core for receiving or supplying the fluid to the core. The tank has external front and rear surfaces adjacent the core and an external side surface between the front and back surfaces, with the side surface having a depression extending between the front and rear surfaces adapted to receive a hose nestled within the tank side surface depression.

In yet another aspect, the present invention is directed to a radiator comprising a core for cooling a fluid, and a tank connected to the core having a side surface with a depression extending between the front and rear surfaces adapted to receive a hose and a plurality of integral ribs formed on the tank external surfaces. The radiator further includes an elongated support member having a body portion removably connected to the core and extending along a side thereof, an end portion removably connected to the tank, and a flexible expansion portion permitting relative movement between the body and end portions to reduce stress during thermal expansion and contraction of the core.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1-7 of the drawings in which like numerals refer to like features of the invention.

Figure 1:
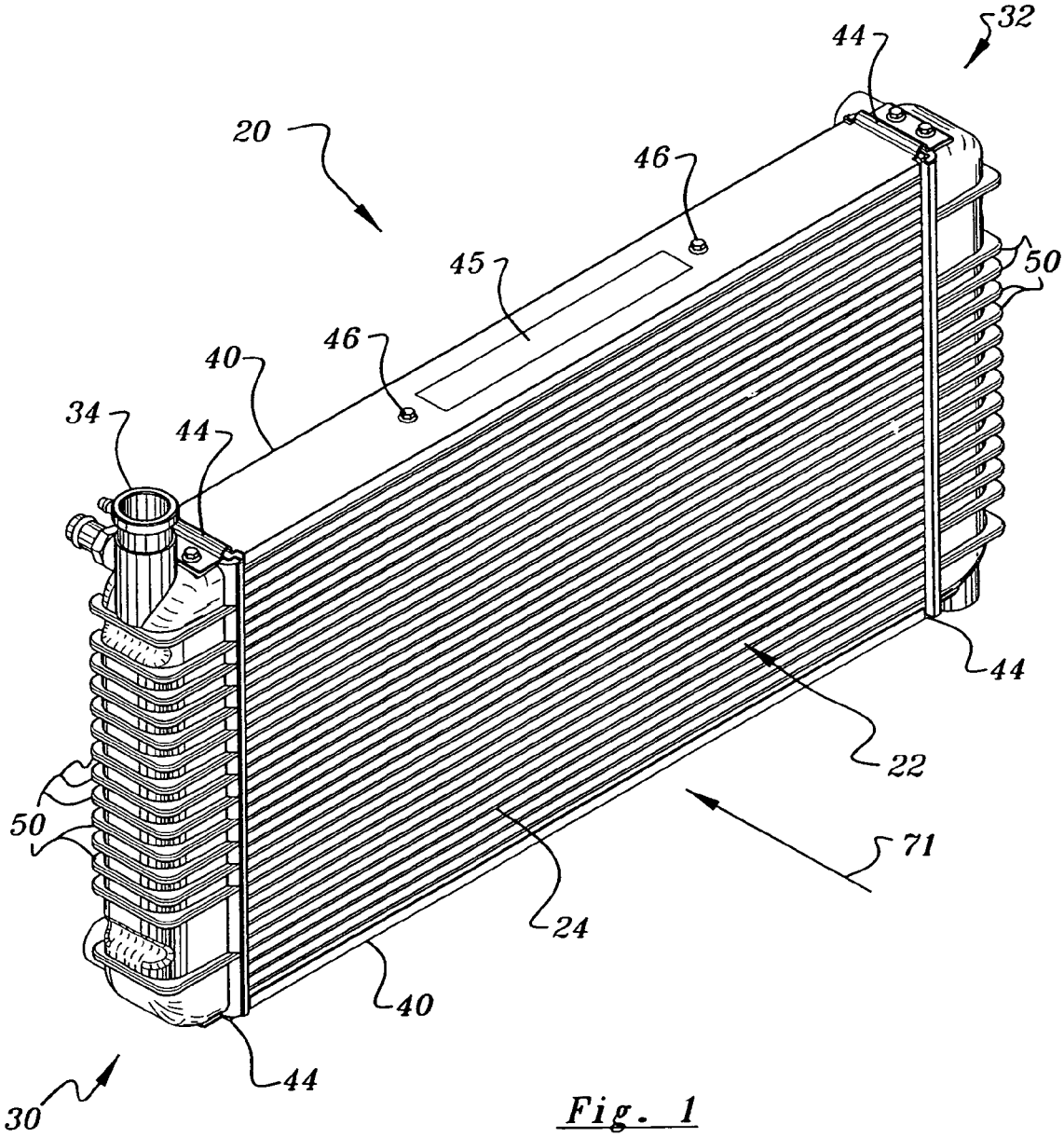
FIG. 1 is a perspective view showing the front of the preferred engine cooling radiator of the present invention.
Figure 2:
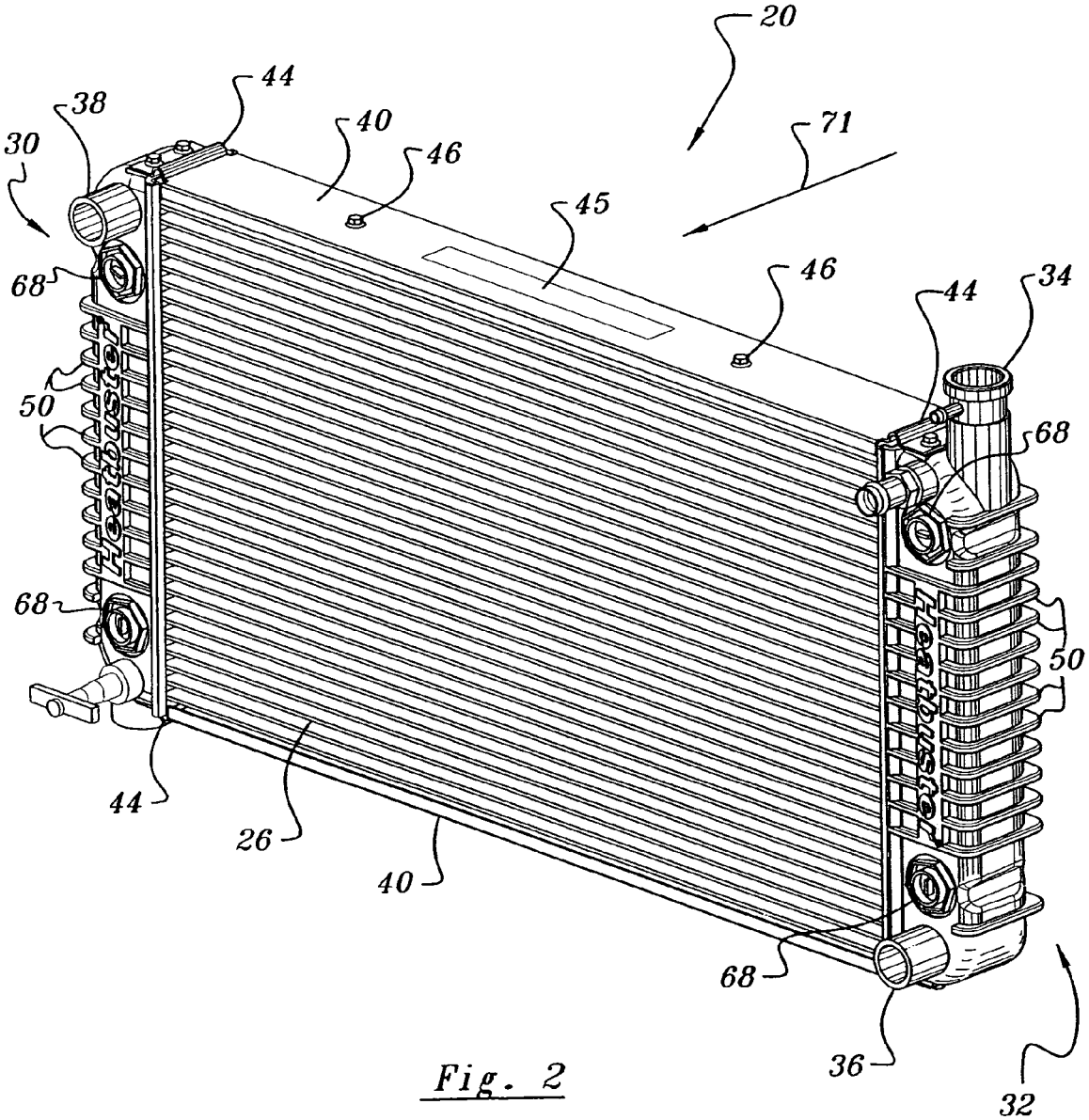
FIG. 2 is a rear perspective view of the radiator of FIG. 1.

The preferred engine cooling radiator of the present invention is shown in FIGS. 1 and 2. The radiator 20 includes an otherwise conventional core 22 having a front 24 and a rear 26, and connected on opposite ends to radiator tanks 30, 32. Air flow direction through the core is indicated by arrow 71. While the radiator shown herein is particularly configured with the tanks horizontally opposed for coolant cross flow within the core, the radiator may be configured in other orientations, for example with vertically opposed radiator tanks for up or down flow through the core. The radiator includes coolant inlet and outlet openings 36, 38 in the tanks for connection by hose to an internal combustion engine (not shown), and a liquid coolant fill inlet 34 in one of the tanks for addition of the engine coolant fluid employed in the cooling system.

Figure 3:
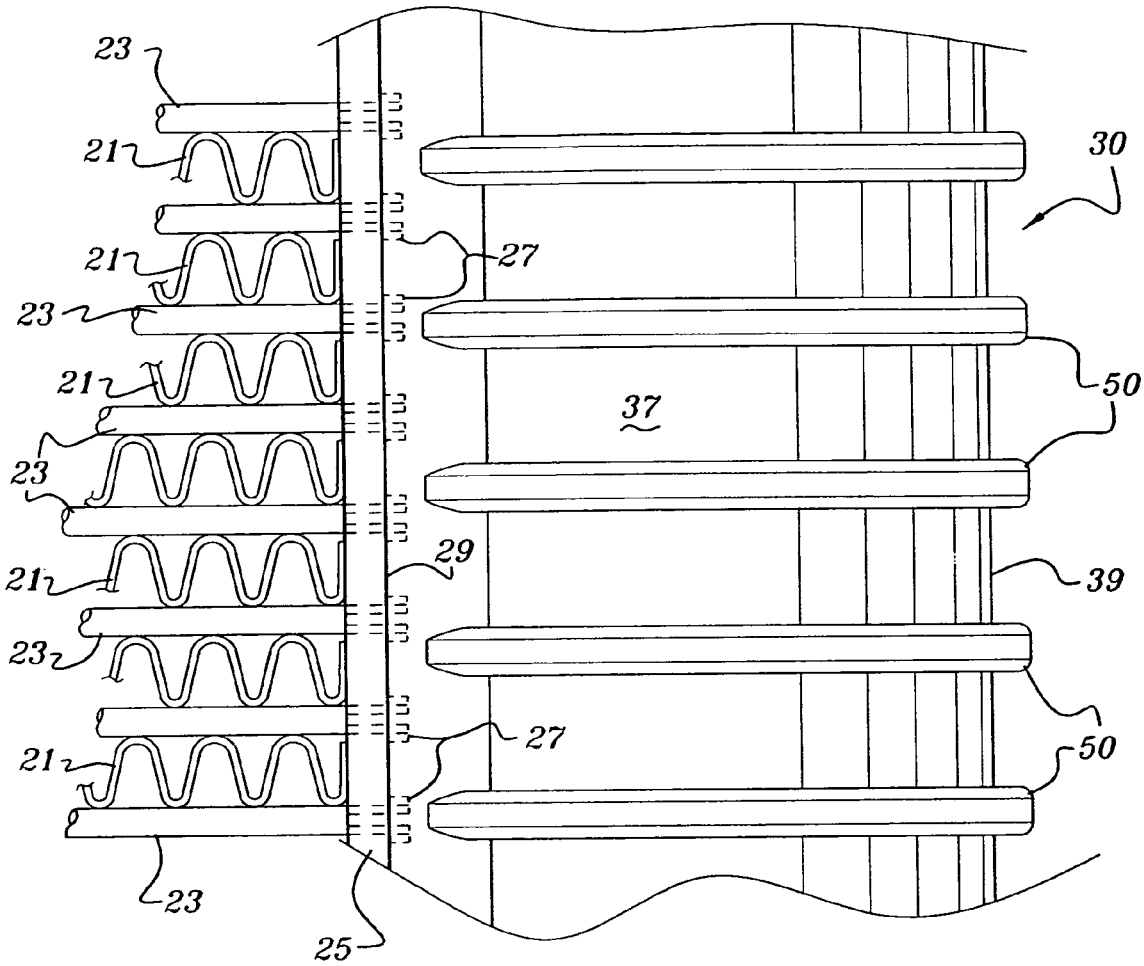
FIG. 3 is an elevational view of the portion of the radiator of FIG. 1 in the vicinity of the header connecting the tank and core.

The connection between the core and tanks is illustrated in FIG. 3, where core 22 is seen comprised of horizontal tubes 23 carrying the engine coolant fluid, and cooling fins 21 extending between the tubes to transfer heat from the coolant fluid to ambient air flowing through the core. The tubes are received in flanged openings 27 in a header plate 25, and are brazed or otherwise secured and sealed to the header. The header in turn is preferably secured and sealed by welding along seam 29 to tank 30, so that the tank may supply or receive coolant fluid to or from the tubes in the core without the common problem of gasket leakage in original equipment radiators. The preferred construction of the radiator of the present invention employs an aluminum core with brazed aluminum tubes and fins, as well as aluminum headers and tanks.

Figure 6:
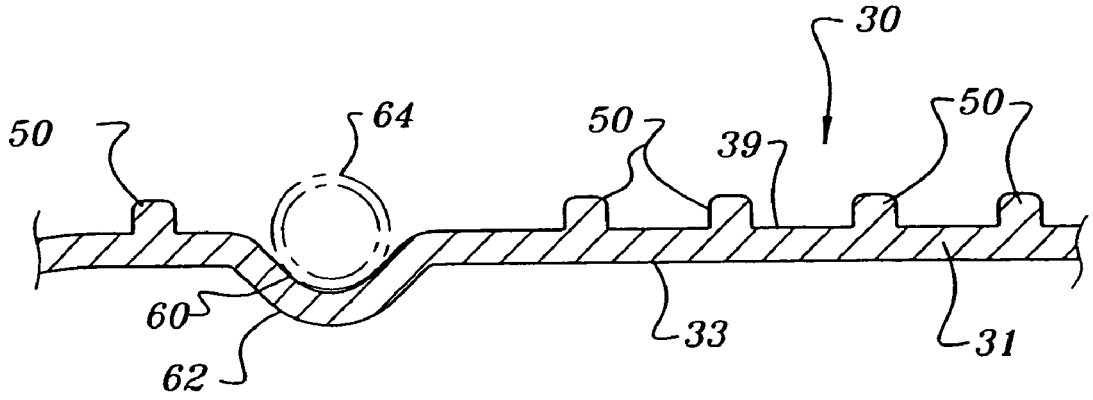
FIG. 6 is a cross-sectional view of a portion of the wall of the tank of FIG. 4.

To provide increased strength and heat transfer capability to the tanks, a series of spaced ribs are formed or otherwise included on the tank external surfaces, as shown in more detail in FIGS. 3-6. The tanks have substantially rectangular front and rear surfaces 37, 35 in essentially the same planes as the core front and rear, 24, 26, and substantially rectangular side surfaces at the opposite ends of the radiator. The ribs 50 are oriented horizontally as shown in the drawings, i.e., in a direction perpendicular to the length of the radiator tanks 30, 32. The ribs extend along at least a portion of the tank side surfaces, preferably completely between the front and rear, and along at least a portion of the tank front or rear surfaces, preferably both. The front and rear ribs may extend only partially along the tank front or rear surface, as shown on tank rear surface 35 in FIG. 4, or along substantially the entire front or rear surface, as shown on tank front surface 37 in FIG. 5. As shown in FIG. 6, the tank wall 31 preferably has a planar or smooth internal surface 33 opposite externally extending ribs 50. The tank may be made by casting, such as die-cast aluminum, so that the finished rib configuration (as well as other tank features) is as-cast integrally with the tanks, without substantial additional finishing (e.g., forming or machining) processes other than aesthetic polishing.

Figure 4:
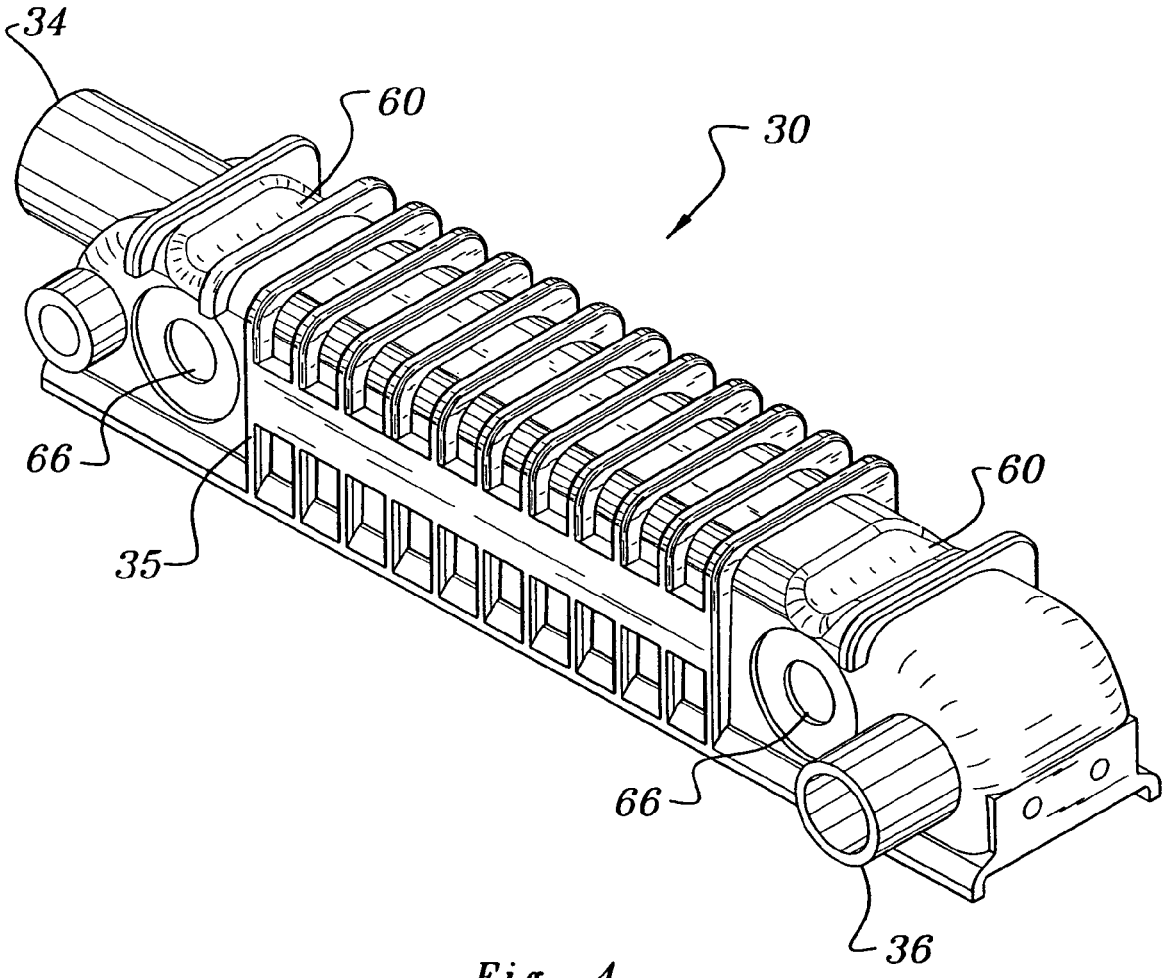
FIG. 4 is a perspective view showing the exterior of one of the tanks on the radiator of FIG. 1.
Figure 5:
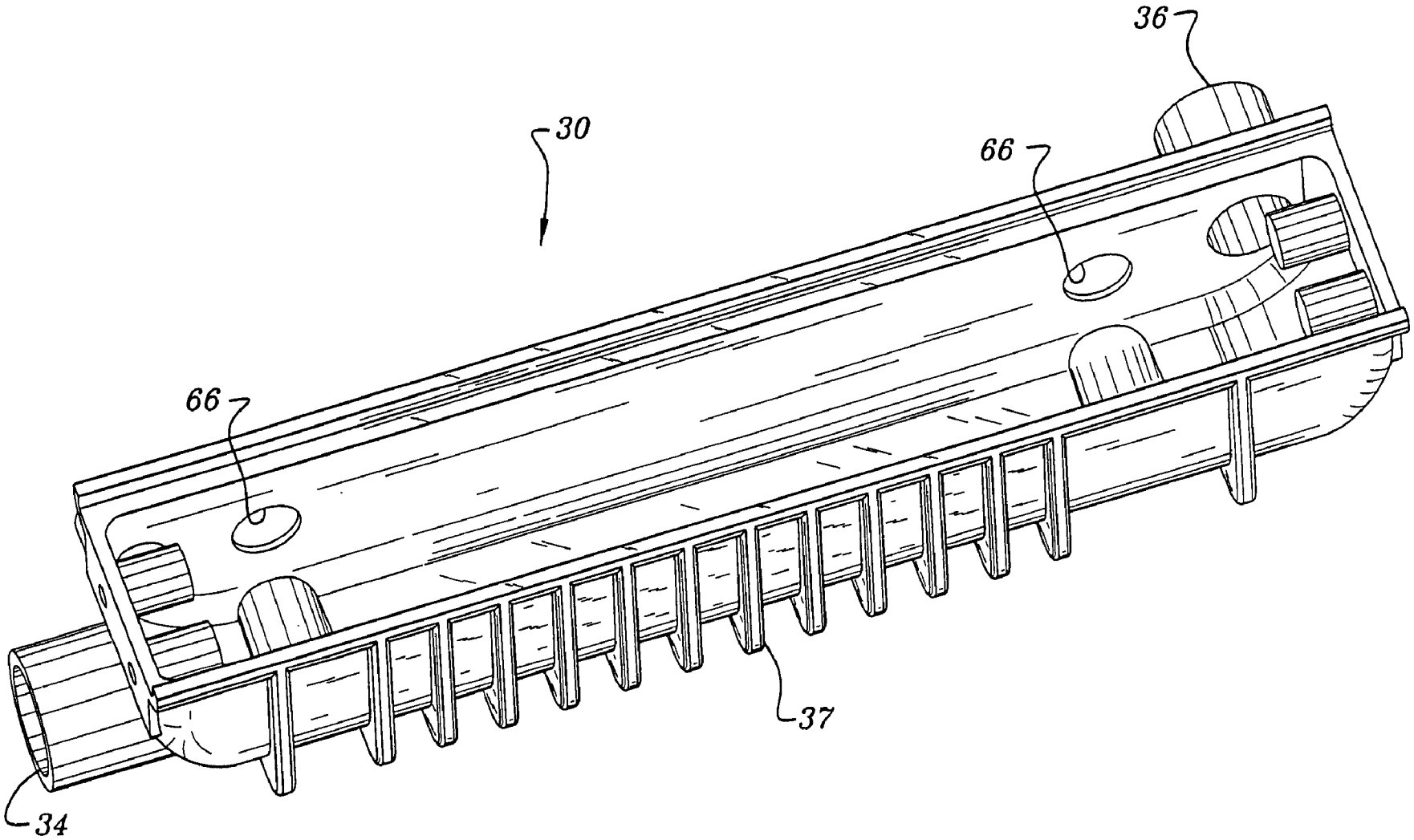
FIG. 5 is a perspective view showing the interior of one of the tanks of FIG. 4.

Since original equipment radiator tanks often have contained within the tanks heat exchangers for cooling other fluids, such as transmission or engine oil coolers, tanks 30, 32 preferably have openings 66 to permit mounting of such internally mounted coolers. In the event that an aftermarket installation requires the replacement of such internal coolers with externally mounted, air-cooled heat exchangers, for performance or other reasons, openings 66 may be capped with plugs 68 (FIG. 2). In such case, the present invention preferably provides indentations or depressions in the tank side external surfaces, extending from front to rear, to receive inlet and outlet oil lines or hoses to be routed from the front to the back of the radiator. FIG. 6 depicts an oil line or hose 64 for an air-cooled transmission or engine oil cooler (not shown) nestled into the tank 30 external side surface 39 indentation or depression 60, to reduce the space requirement for such hose. The thickness of tank wall 31 is maintained by a corresponding bulge 62 on the internal wall 33 opposite indentation 60. Such indentations 60 may be adjacent each end of tanks 30, 32 (FIG. 4).

Figure 7:
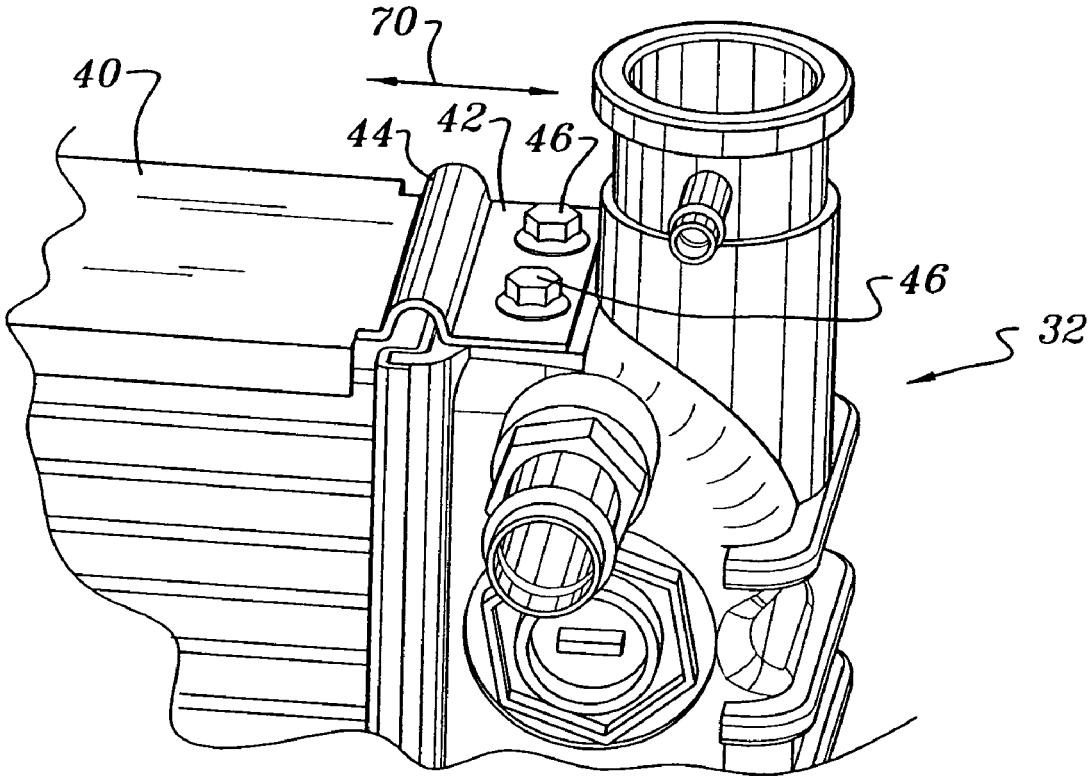
FIG. 7 is a perspective view of a portion of the radiator of FIG. 1 in the vicinity of the flexible expansion link in the support member between the core and one of the tanks.
Figure 8:
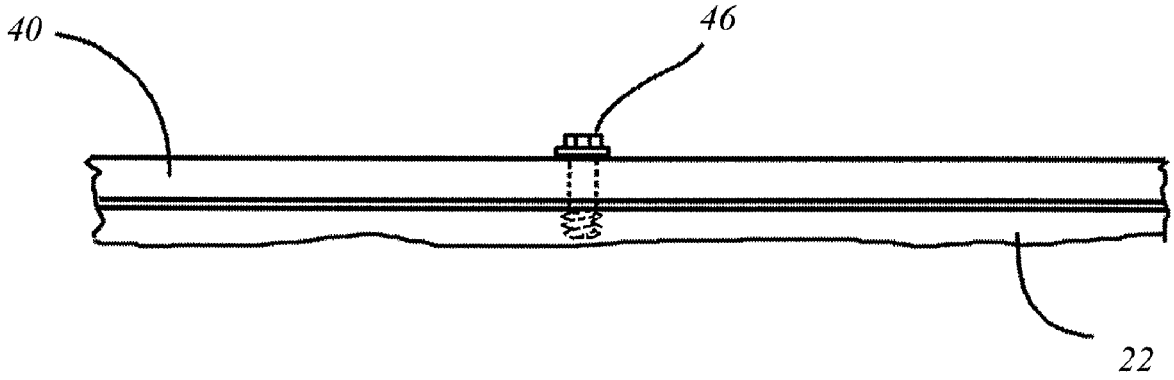
FIG. 8 is a side elevational view of a portion of the radiator of FIG. 1 showing the threaded fastener removably securing the support member to the core.

Mechanical support for the radiator components is provided in part by support members 40 extending across the upper and lower sides of radiator 20 (FIGS. 1 and 2), which are removably secured to the core 22 FIG. 8 and tanks 30, 32 by threaded fasteners 46. As shown in FIG. 7, the support member 40 end portion 42 secured to tank 32 is connected to the remaining body portion (which is secured to the core) by expansion link 44, which is preferably a U-shaped portion of the flat strip from which the support member 40 is formed. Such links are provided at each end of each tank, at the point of connection to the support members. The portion of support member 40 secured to the core may include a longitudinal stiffening rib 45 formed along the length thereof. Although the support member may be typically made from steel or other high strength material, the link configuration permits flexibility and relative movement between the support body and end portions in the directions indicated by arrow 70. Such relative movement is desirable because of the different degrees of thermal expansion and contraction undergone by the various radiator components, particularly the core, as the radiator cycles between ambient temperature when the engine is off, and the elevated operating temperature after the engine is running.

Thus, the present invention provides an improved and distinctive radiator for high performance motor vehicle applications which has increased strength and heat transfer and is less susceptible to thermal stresses. The engine cooling radiator of the present invention also permits modification of associated heat exchangers, such as transmission or engine oil coolers.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A radiator comprising:

a core for cooling a fluid, the core having front and back surfaces, opposite sides between the front and back surfaces, and opposite ends between the front and back surfaces;

a tank connected to the core at an end thereof and for receiving or supplying the fluid to the core; and an elongated member support having a body portion removably secured to the core and extending along a side thereof, an end portion removably secured to the tank, and a flexible expansion portion permitting relative movement between the body and end portions to reduce stress during thermal expansion and contraction of the core.

2. The radiator of claim 1 wherein the flexible expansion portion is U-shaped.

3. The radiator of claim 1 further including threaded fasteners removably securing the elongated support to the core and tank.

4. The radiator of claim 1 including a pair of tanks connected to opposite ends of the core, and wherein the elongated support member includes an end portion removably secured to each of the tanks, and a flexible expansion portion between the body portion and each end portion.

5. The radiator of claim 4 wherein the core has opposite sides, and further including an elongated support member on each side of the core removably secured to the core and the tanks.

6. The radiator of claim 1 wherein the tank has external front and rear surfaces adjacent the core and an external side surface between the front and back surfaces, the side surface having a depression extending between the front and rear surfaces adapted to conform to and receive a portion of a hose, and further including a hose nested within the tank side surface depression, the hose having a portion thereof extending above the tank side surface.

7. The radiator of claim 1 wherein the core has tubes for carrying the fluid, and further including a header for connecting the tank to the tubes, the header being welded to the tank.

* * * * *